US005943792A

United States Patent [19]

Powell

[11] Patent Number: 5,943,792

[45] Date of Patent: Aug. 31, 1999

[54] FOOTWEAR TRACTION DEVICE

[76] Inventor: Douglas S. Powell, 3205 Glenridge Dr., Raleigh, N.C. 27604

[21] Appl. No.: 09/174,432

[22] Filed: Oct. 16, 1998

Related U.S. Application Data

[60] Provisional application No. 60/062,898, Oct. 20, 1997.

[51] Int. Cl.[6] ..... A43C 15/00; A43B 3/10; A47K 7/02

[52] U.S. Cl. ..... 36/62; 36/7.5; 15/227

[58] Field of Search ..... 36/8.1, 7.1 R, 36/7.5, 62, 132, 136, 113; 15/227

[56] References Cited

U.S. PATENT DOCUMENTS

| | | | |
|---|---|---|---|
| 1,558,378 | 10/1925 | McAuley . | |
| 2,071,365 | 2/1937 | Stroop | 15/227 |
| 2,075,229 | 3/1937 | Rose | 36/8.1 |
| 2,166,958 | 7/1939 | Lawson | 36/62 |
| 2,208,200 | 7/1940 | Sloan | 36/62 |
| 2,258,322 | 10/1941 | Frolich | 36/7.7 |
| 2,366,649 | 1/1945 | Priess | 36/62 |
| 2,408,152 | 9/1946 | Porcelli | 36/59 |
| 3,258,863 | 7/1966 | Paget | 36/62 |
| 3,461,575 | 8/1969 | Tead et al. | 36/7.5 |
| 3,699,672 | 10/1972 | Sims | 36/7.7 |
| 3,733,721 | 5/1973 | Clemens | 36/7.5 X |
| 4,702,021 | 10/1987 | Cameron | 36/62 |
| 4,896,439 | 1/1990 | Morgan | 36/7.5 |
| 5,259,125 | 11/1993 | Gromes | 36/7.5 X |
| 5,485,687 | 1/1996 | Rohde | 36/62 |
| 5,613,897 | 3/1997 | Thompson, Jr. | 15/227 |

*Primary Examiner*—B. Dayoan
*Attorney, Agent, or Firm*—Mills Law Firm PLLC

[57] ABSTRACT

An improved footwear traction device designed to provide enhanced traction for the wearer while walking on ice, snow, and other slippery surfaces without causing damage to finished floors and carpeting is disclosed. The footwear traction device includes an elastic member having releasable engaging member for attaching the device about the sole and instep of the wearer's shoe. The traction device includes a reversible, frictional component fabricated from a hygroscopic fibrous material which is instantaneously frozen when the water-laden frictional component is placed into direct contact with an icy surface thereby temporarily freezing the wearer's shoe to the icy surface to provide improved traction. The frictional component is constructed to include an interrupted, ribbed pattern on the ground engaging surface thereof which is disposed transversely to the direction of walking so as to provide a measure of mechanical resistance to slippage on surfaces which are not completely frozen.

7 Claims, 1 Drawing Sheet

FOOTWEAR TRACTION DEVICE

CROSS-REFERENCE TO RELATED APPLICATION

This application claims the benefit under 35 U.S.C. 119(e) of U.S. provisional application Ser. No. 60/062,898 filed Oct. 20, 1997 by Douglas S. Powell for Ice Walkers.

BACKGROUND OF INVENTION

1. Field of Invention

This invention relates to foot wear traction devices and, more particularly, to an improved traction device for icy surfaces.

Footwear traction devices to improve traction for the wearer on slippery surfaces are well known to those skilled in the art. Typically, such devices have been designed to improve the wearer's traction while walking on ice and include metallic spikes for gripping the surface of the ice.

For example, U.S. Pat. Nos. 2,366,649, 2,208,200, and 2,166,958 disclose devices utilizing metallic spikes which can be attached about the instep of a shoe. However, the use of metallic spikes tends to damage hardwood floors, tile, and carpet encountered when entering or leaving a building to walk on the ice.

Still other footwear traction devices have utilized abrasive grit materials embedded in a pad or plate which is attached to the bottom of the wearer's shoe to provide friction on the ice. U.S. Pat. Nos. 4,702,021 and 5,485,687 disclose shoe attachment devices of the abrasive type which are also unsuitable for use on floors and carpets.

Although such traction devices including metallic spikes and abrasive grit have proven to be useful under moderate snow conditions, they have proven to be ineffective during severe ice storms when the icy surface cannot be easily penetrated.

Thus, the present invention has been developed to provide a footwear traction device including a non-abrasive, water absorbent material which may be conveniently attached about the instep of the wearer's shoe to provide frictional engagement with icy surfaces without marring finished floors when entering and leaving a building.

2. Description of Related Prior Art

U.S. Pat. No. 2,366,649 to Louis A. Priess discloses an ice gripper device to prevent the wearer from slipping when walking on ice, slippery grass, moss and the like. The ice gripper is stamped from a single sheet of metal, includes a flat body member having at each of its longitudinal edges a row of depending sharp teeth. The ice gripper is removeably held on the soles of the shoe with its two rows of teeth extending transversely of said shoe by an elastic webbing.

U.S. Pat. No. 2,208,200 to George E. Sloan also discloses an ice walker adapted to be attached to a shoe or boot to prevent slipping when walking on ice. In this invention the ice walker includes a body member formed from a strip of sheet metal having spurs or spikes punched through a central portion and having the ends turned up for the attachment of a band which is adapted to encircle the arch of the shoe or boot for holding the ice walker in working position.

U.S. Pat. No. 2,166,958 to Frans O. Lawson discloses an anti-slipping device which is worn on a shoe, boot, or overshoe to prevent the wearer from slipping on ice or other slippery surfaces. This device comprises an integral strip of elastic material having a central portion which carries a plurality of spurs and resilient fastening portions or flaps by which the device is secured to the foot of the wearer. The flaps includes openings which are located and adjusted on opposite sides of the ankle bone of the wearer to securely hold the device against forward or rearward movement relative to the shoe.

U.S. Pat. No. 4,702,021 to Emmett H. Cameron discloses a shoe traction apparatus comprising an elongated strap member provided with releasable engaging means on the ends, an upper frictional unit and a lower composite frictional unit formed intermediate the ends such that the upper frictional unit engages the sole of the user's shoe and the lower composite frictional unit that engages a slippery surface. The lower composite frictional unit comprises particles of rock or, an in an alternative embodiment, comprises seed particles which function to provide scattered edible foodstuffs for birds as they are worn off by contact with the icy surface.

U.S. Pat. No. 5,485,687 to Gilbert Rohde discloses an anti-slip shoe attachment device which consists of a plate that fits against the bottom of the sole of the shoe. A slip preventing structure on the bottom of the plate consists of a plurality of cleats. Each cleat is punched into the plate and bent downwardly so that each cleat will extend below the plate.

U.S. Pat. No. 3,258,863 to Blanche Paget discloses safety footwear for bath or shower comprising a body member formed of an elastomeric material such as natural or synthetic rubber. The top or inside surface of the body member is smooth while the bottom or outside is provided with a slightly raised screen finish which provides a plurality of small protuberances in a grid pattern across the entire bottom surface of the body member. A relatively thin piece of cloth material, preferably terrycloth, is then placed in overlying relationship to the center of the body member whereon the cloth is bonded.

U.S. Pat. No. 2,258,322 to Lill K. Frolich discloses an anti-skid shoe device including a tapered cylindrical body member formed of a flexible cloth and having attached thereto a plurality of transversely disposed spaced apart elastic bands. The body member is open at each end thereof such that the toe of the shoe may be inserted therein being disposed a few inches from the toe of the shoe. The opposite ends of a resilient strap are secured to the body member and extend over the heel of the shoe whereby the device is prevented from movement toward the toe of the shoe. The elastic bands extend across the bottom portion of the body member providing a ribbed structure such that the feet of the user are prevented from slipping or skidding upon snow and ice covered pavement.

U.S. Pat. No. 2,408,152 to Alfonso Porcelli discloses an anti-skid canvass device formed of heavy canvass that presents a coarse grained or rough surface and upon one face thereof is provided with an adhesive coating. At spaced points along the marginal edge of the sole shaped device there is provided a plurality of outwardly extending ears or tabs also having an adhesive coating on one side. With the anti-skid canvass device attached to the sole of the shoe, slipping on wet or ice covered pavements is prevented.

Finally, U.S. Pat. No. 1,558,378 to George C. McAuley is considered of general interest in that it discloses a shoe attachment for shoes to be worn by bowlers. The shoe attachment is preferably made of buckskin and configured to fit the sole of an ordinary shoe. The shoe attachment includes an adjustable strap which extends about the heel of the shoe wearer to retain it thereon.

SUMMARY OF THE INVENTION

The improved footwear traction device of the present invention was designed to provide traction for the wearer while walking on ice, snow and other slippery surfaces without damaging finished indoor floors and carpets. Further, the present invention may be quickly and easily attached or detached from a wearer's shoe.

The improved footwear traction device of the present invention comprises an elastic member with releasable engaging means such as VELCRO fasteners for attaching the device about the sole and instep of the wearer's shoe. The traction device includes a frictional component fabricated from a hygroscopic fibrous material which instantaneously freezes as the water laden fibers are brought into contact with the ice or snow with each step of the wearer to produce frictional contact.

The frictional component is configured so as to provide a mechanical resistance with the ground surface to provide additional traction on the surfaces which are not completely frozen.

In view of the above, it is an object of the present invention to provide an improved footwear traction device which provides all around traction to the wearer when walking on ice, snow, and other slippery surfaces without damaging finished floors and carpets upon entering or leaving a building.

Another object of the present invention is to provide a traction device having a frictional component fabricated from a hygroscopic material which instantaneously freezes when the water-laden fibers are brought into contact with an ice or snow covered surface.

Another object of the present invention is to provide an improved footwear traction device wherein the frictional component is reversible so as to enhance frictional contact with the sole of the wearer's shoe and, in addition, to extend its longevity.

Another object of the present invention is to provide an improved footwear traction device that is designed to be quickly and conveniently attached or detached from the wearer's shoe for the convenient storage thereof when not in use.

Another object of the present invention is to provide an improved footwear traction device which is fabricated from readily available materials at a low manufacturing cost.

Other objects and advantages of the present invention will become apparent and obvious from a study of the following description and the accompanying drawings which are merely illustrative of such invention.

DETAILED DESCRIPTION OF THE PREFERRED EMBODIMENT

Figure 1:
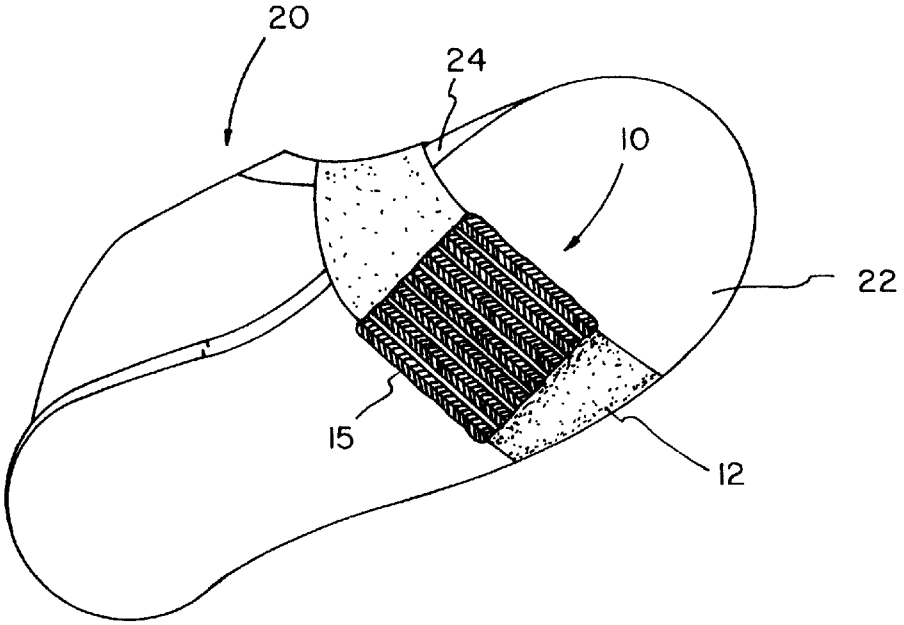
FIG. 1 is a perspective view showing the footwear traction device of the present invention attached about the instep of a shoe with the frictional component positioned under the sole of the shoe.

With reference to the drawings, there is shown therein an improved footwear traction device or ice walker in accordance with the present invention, indicated generally at 10 as illustrated in FIG. 1. The traction device 10 is shown attached in its functional position about the instep of shoe 20 such that the frictional component 15 is positioned under the sole 22 of the shoe.

Figure 2:
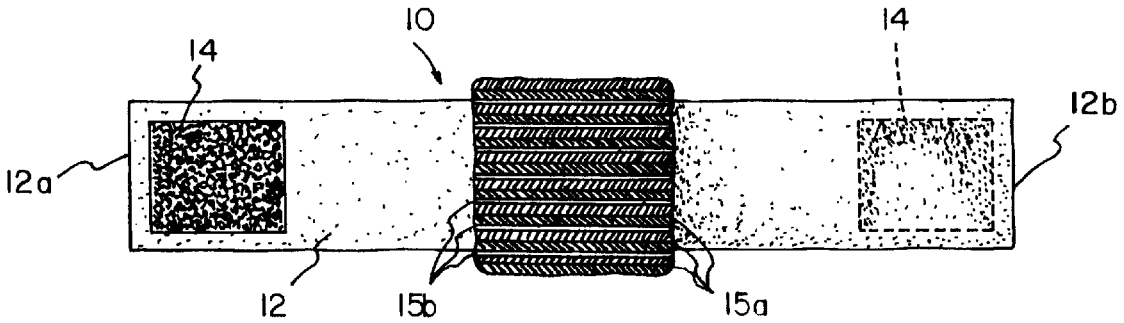
FIG. 2 is a plan view of the footwear traction device showing the detachable fastening means in a disengaged condition.

As more clearly shown in FIG. 2, the traction device 10 includes an elongated elastomeric strap member 12 of sufficient length to encircle the instep portion 24 of the shoe. In the preferred embodiment the strap member 12 is fabricated from a resilient, elastic material capable of expansion and contraction.

The strap member 12 is provided with detachable fastening means 14 at either end thereof to permit the strap member 12 to be secured about the shoe under tension.

In the preferred embodiment, the detachable fastening means 14 are comprised of mating portions of a hook and loop type fastener such as VELCRO fasteners which are positioned on opposite surfaces of each end 12*a* and 12*b* of the strap member 12.

Of course, other detachable fastening means may be utilized for this purpose and the VELCRO fasteners described hereinabove are intended to be merely illustrative and not restrictive in any sense.

Since such detachable fastening means are well known to those skilled in the art, further detailed discussion of the same is not deemed necessary.

Figure 3:
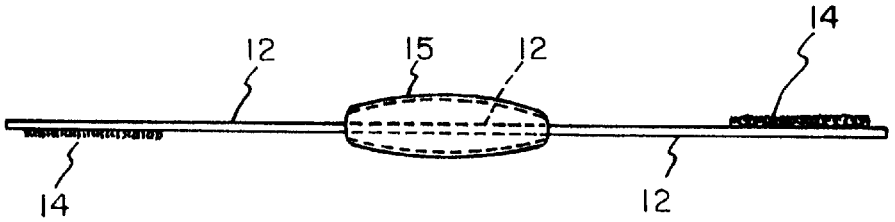
FIG. 3 is a side elevational view of the footwear traction device showing the reversible frictional component thereof.

As shown in FIG. 3 the frictional component, pad 15, is tubular in construction so as to completely encircle strap member 12 and be symmetrically disposed on either side thereof. It will be appreciated by those skilled in the art that this arrangement is designed to enhance the frictional engagement of the traction device 10 with the sole 22 of the user's shoe, and, at the same time, makes the traction device reversible to extend its longevity.

In the preferred embodiment, the frictional pad 15 is fabricated from a hygroscopic woven material tending to absorb water such as cotton, wool or other natural fibers which is sewn to strap member 12. Of course, other hygroscopic materials having excellent characteristics of water absorbency may be suitable for this purpose and are considered to be within the scope of the present invention.

As most clearly shown in FIG. 2, the pad 15 is woven in a ribbed pattern having a plurality of generally parallel raised sections 15*a* and a plurality of alternating recessed sections 15*b* therebetween in the manner of a conventional sock, for example.

In practical use the pad 15 is adapted to yield when stretched during bending movements of the sole 22 incident to walking movements of the user's foot such that the raised sections 15*a* of the pad 15 are compressed and released as the sole 22 alternately contacts and is raised up from the ground surface during bending movements of the user's shoe during walking.

Thus, it will be appreciated that during use the pad 15 is caused to undergo sufficient changes in contour and surface area to inhibit the accumulation of snow and debris which would otherwise accumulate on the pad 15 if it were constructed to have an even contour instead of the interrupted, ribbed design.

Further, it will be appreciated that the ribbed pattern is disposed transversely to the direction of walking so as to provide a measure of mechanical resistance to slippage on any slippery surface.

Critical to the present invention, the hygroscopic nature of the fibers from which the pad 15 is constructed will cause it to retain water in the liquid state. When the water-laden pad 15 is placed into direct contact with an icy surface, the water within the fibers is instantaneously frozen causing the pad 15 and hence the wearer's shoe to be temporarily frozen to the icy surface to provide improved traction.

Thus, the combined mechanical friction of the ribbed surface of the pad 15 together with the freezing of the hygroscopic fibrous material provides enhanced traction and increased safety to the wearer while walking on frozen surfaces.

From the above it can be seen that the present invention provides an improved footwear traction device which may be conveniently attached to the user's footwear to provide increased traction on ice, snow, and other slippery surfaces.

The improved traction device includes a frictional component having an interrupted surface which is fabricated from a hygroscopic fibrous material wherein water-laden fibers are frozen to the surface of the ice upon contact therewith to prevent slippage and injury to persons walking on such surfaces.

Further, the frictional component or pad of the present traction device is reversible in configuration providing enhanced frictional engagement with the sole of the wearer's shoe and extended longevity during use.

In addition, the improved footwear traction device is constructed of entirely non-abrasive materials to provide frictional engagement with icy and slippery surfaces without marring finished floors when entering and leaving a building.

The terms "upper", "lower", "side", and so forth have been used herein merely for convenience to describe the present invention and its parts as oriented in the drawings. It is to be understood, however, that these terms are in no way limiting to the invention since such invention may obviously be disposed in different orientations when in use.

The present invention may, of course, be carried out in other specific ways than those herein set forth without departing from the spirit and essential characteristics of such invention. The present embodiments are, therefore, to be considered in all respects as illustrative and not restrictive, and all changes coming within the meaning and equivalency range of the appended claims are intended to be embraced therein.

What is claimed is:

1. A footwear traction device for releasable attachment to a wearer's shoe comprising:

an elastic strap member including releasable attaching means of sufficient length to encircle the instep portion of said shoe; and a reversible frictional component including a generally tubular pad member being radially disposed about said strap member in symmetrical relation thereto, said pad member being fabricated from a hygroscopic fibrous material wherein water is absorbed and instantaneously frozen when said pad member is pressed into direct contact with an icy surface thereby providing enhanced traction to the wearer.

2. The traction device of claim 1 wherein said attaching means includes mating portions of a hook and loop type fastener.

3. The traction device of claim 1 wherein a ground-contacting surface of said pad member includes a plurality of parallel raised sections alternating with a plurality of recessed sections in a ribbed pattern.

4. The traction device of claim 3 wherein said plurality of raised and recessed sections are disposed transversely to the direction of walking to provide mechanical resistance to slippage on a slippery surface.

5. An improved footwear traction device of the type having an elongated, flexible strap member including releasable attachment means on opposite ends thereof for attaching said device about the instep of a user's footwear and a frictional component attached intermediate the ends of said strap member such that said frictional component is disposed in direct contact with the ground surface, said improvements comprising:

a reversible frictional component including a tubular pad member being radially disposed about said strap member in symmetrical relation thereto, said pad member being fabricated from a hygroscopic fibrous material wherein water is absorbed and instantaneously frozen when pressed into direct contact with an icy surface whereby a user is provided with increased traction on icy surfaces.

6. The traction device of claim 5 wherein a ground-contacting surface of said pad member includes a plurality of parallel raised sections alternating with a plurality of parallel recessed sections to provide a ribbed pattern.

7. The traction device of claim 6 wherein said plurality of alternating raised and recessed sections are disposed transversely to the direction of walking so as to provide mechanical resistance to slippage on any slippery surface.

* * * * *